US007121871B2

(12) United States Patent
Duesterhoeft et al.

(10) Patent No.: US 7,121,871 B2
(45) Date of Patent: Oct. 17, 2006

(54) WIRE TAP CONNECTOR AND CONTACT THEREFOR

(75) Inventors: Scott Stephen Duesterhoeft, Etters, PA (US); David James Fabian, Mount Joy, PA (US); Stanley Allen Kline, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/036,750

(22) Filed: Jan. 14, 2005

(65) Prior Publication Data

US 2006/0160403 A1 Jul. 20, 2006

(51) Int. Cl.
*H01R 4/24* (2006.01)

(52) U.S. Cl. ..... 439/417; 439/404

(58) Field of Classification Search ..... 439/403–404, 439/417–418

See application file for complete search history.

(56) References Cited

U.S. PATENT DOCUMENTS

| | | | | |
|---|---|---|---|---|
| 3,388,370 A | | 6/1968 | Elm | 339/98 |
| 4,037,905 A | | 7/1977 | Lucas | 339/98 |
| 4,130,331 A | | 12/1978 | Neff et al. | 339/97 R |
| 4,212,509 A | | 7/1980 | Brooks et al. | 339/95 D |
| 4,981,443 A | | 1/1991 | Suverison et al. | 439/398 |
| 5,338,220 A | * | 8/1994 | Soes et al. | 439/403 |
| 5,588,869 A | * | 12/1996 | Jensen et al. | 439/417 |
| 5,681,182 A | * | 10/1997 | Reichle | 439/417 |
| 5,989,057 A | * | 11/1999 | Gerke et al. | 439/417 |
| 6,488,539 B1 | * | 12/2002 | Turek et al. | 439/620 |
| 2003/0184204 A1 | | 10/2003 | McCoy et al. | 313/318.12 |

FOREIGN PATENT DOCUMENTS

| | | |
|---|---|---|
| DE | 202 05 665 | 10/2002 |
| DE | 102 01 495 | 8/2003 |

OTHER PUBLICATIONS

International Search Report, International application No. PCT/US2006/001051.

* cited by examiner

*Primary Examiner*—Michael C. Zarroli

(57) ABSTRACT

A contact for a wire tap connector includes a substantially planar insulation displacement portion configured to receive a primary wire and electrically connect thereto, and a poke in wire section integrally formed with and attached to the planar insulation displacement portion. The poke in wire section is configured to accept a prepared connecting wire in one or more positions relative to the insulation displacement portion. When the contact is situated in a housing, a slidable stuffer may be provided to quickly and easily install the connector assembly to a primary run wire.

16 Claims, 5 Drawing Sheets

WIRE TAP CONNECTOR AND CONTACT THEREFOR

BACKGROUND OF THE INVENTION

This invention relates generally to electrical connectors, and, more particularly, to slidable electrical connectors for coupling to a continuous wire extending through the connector.

In certain electrical systems, such as, for example, lighting applications, it is desirable to run a primary power wire, sometimes referred to as a "run wire" and to connect or tap into the run wire at various points to power peripheral devices, such as lighting devices. Typically, a connector is used to tap into or connect to the run wire, and another connecting wire is used to connect the wire tap connector to the peripheral device. Known connectors fur such purposes, are however, disadvantaged in several aspects.

Some known wire tap connectors require that the primary wire be cut or stripped of insulation to secure the wire conductors to the connector. Cutting and/or stripping of the primary wire can be time consuming, and in some installations can be challenging. Increased time or complexity in installing to the wire tap connectors translates into increased installation costs, and a lower cost installation is desired.

In other known wire tap connectors, the connecting wires from the wire tap connector to another device (e.g., a lighting device) must also be cut or stripped to terminate the connecting wire to the wire tap connector, thereby further increasing installation time and difficulty.

Additionally, with known wire tap connectors, one wire tap connector is required for each device connected to the primary run wire. Particularly when a large number of peripheral devices are to be installed, or when more than one peripheral device is desired in the same general area, separately installing wire tap connectors for each peripheral device can be unnecessarily time consuming and difficult.

BRIEF DESCRIPTION OF THE INVENTION

According to an exemplary embodiment, a contact for a wire tap connector is provided. The contact comprises a substantially planar insulation displacement portion configured to receive a primary wire and electrically connect thereto, and a poke in wire section integrally formed with and attached to the planar insulation displacement portion. The poke in wire section is configured to accept a prepared or stripped connecting wire in at least two positions relative to the insulation displacement portion.

Optionally, the poke in wire section includes contact beams extending obliquely to the insulation displacement portion. The contact may include first and second ledges extending substantially perpendicular to the insulation displacement portion, and the poke in wire section may extend between the first and second ledges and extend obliquely to the insulation displacement portion and extend obliquely to the ledges.

According to another embodiment, a wire tap connector comprises a housing having opposite side edges and a longitudinal cavity extending between the opposite side edges. The longitudinal cavity is configured to receive a primary wire extending axially and continuously through the housing, and a contact is situated in the housing. The contact has an insulation displacement portion extending into the cavity and a poke in wire section extending from the insulation displacement portion. The poke in wire section is configured to receive a connecting wire in one or more positions.

According to still another embodiment, a wire tap connector comprises a housing having opposite side edges defining a wire cradle. The wire cradle is configured to receive a primary wire along an axis of the wire, and a contact is situated in the housing. The contact has an insulation displacement portion extending into the cradle and a poke in wire section extending from the insulation displacement portion, and the poke in wire section is configured to receive a connection wire in more than one position. A stuffer is selectively positionable relative to the housing to engage the primary wire to the insulation displacement portion.

DETAILED DESCRIPTION OF THE INVENTION

Figure 1:
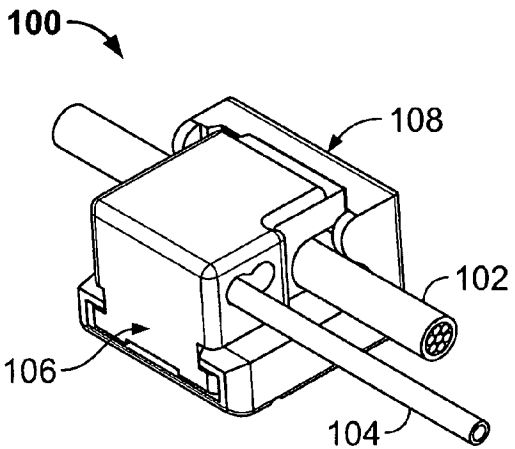
FIG. 1 is a perspective view of a wire tap connector assembly formed in accordance with an exemplary embodiment of the present invention and in a terminated position.

FIG. 1 is a perspective view of a wire tap connector assembly 100 formed in accordance with the present invention and in a terminated position with a primary wire or "run wire" 102. In the terminated position, a connecting wire 104 is connected to the primary wire 102 to power a peripheral device (e.g., a lighting device). As explained below, the wire tap connector assembly 100 permits installation to the primary wire 102 without stripping the primary wire 102 of insulation and also permits a poke in connection of the connecting wire 104 that requires minimal time and effort to complete. Moreover, and as explained below, the connector assembly 100 is adapted for connecting to a connecting wire in more than one position, and is therefore capable of quick and easy connection to multiple connecting wires 104. Multiple connections may therefore be established to the connector assembly 100 with reduced time and reduced difficulty in comparison to known wire tap connectors.

In an exemplary embodiment, the connector assembly 100 includes a housing 106 and a stuffer 108 which is slidably mounted to the housing 106. The housing 106 includes a contact (not shown in FIG. 1) therein which is configured to engage both the primary wire 102 and the connecting wire 104 as explained below. The stuffer 108 engages the primary wire 102 and is selectively positionable relative to the housing 106 between an assembled position (described below in relation to FIG. 7) and the terminated position shown in FIG. 1.

Figure 2:
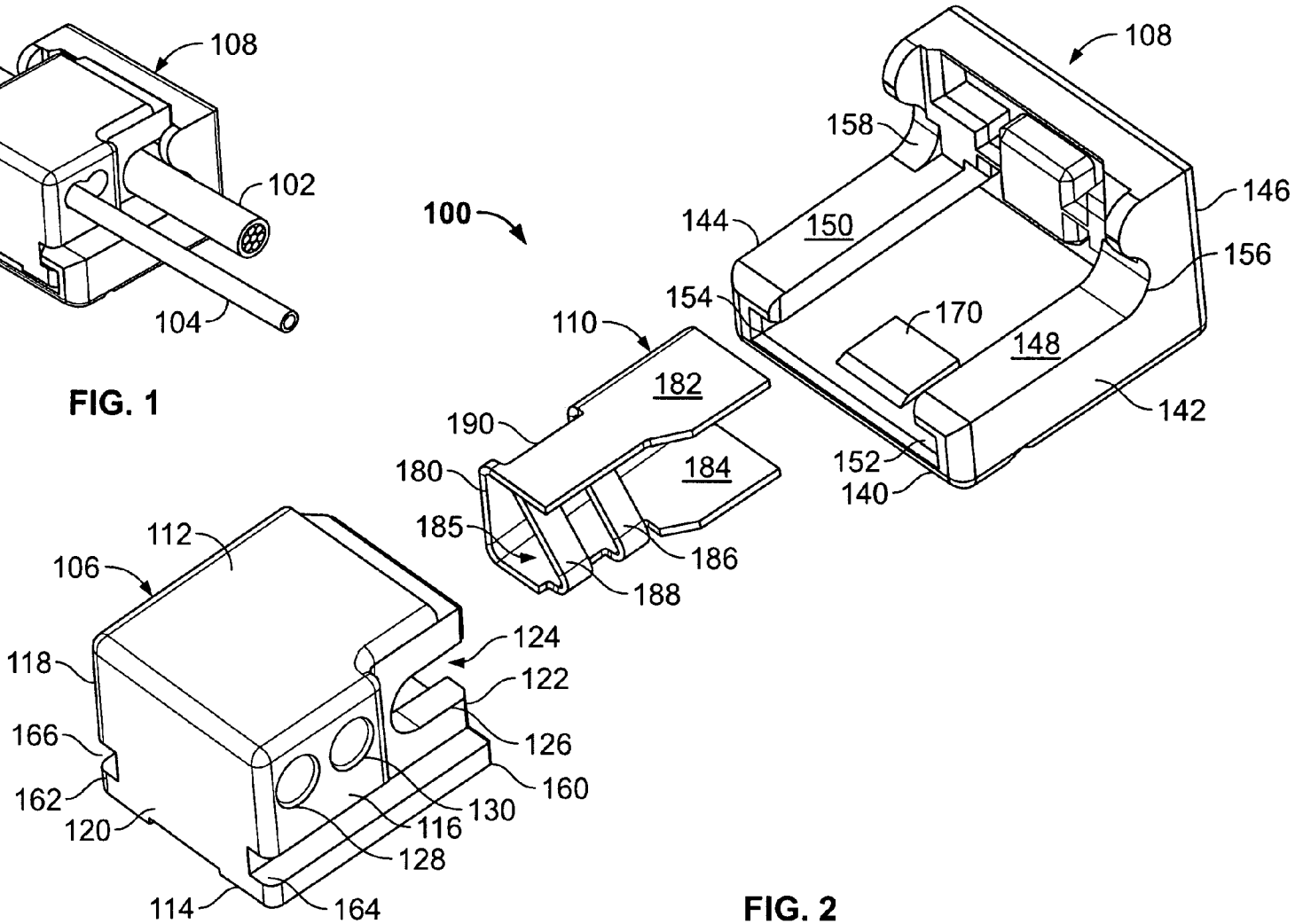
FIG. 2 is an exploded view of the connector assembly shown in FIG. 1.

FIG. 2 is an exploded view of the connector assembly 100 including the housing 106, the stuffer 108, and a contact 110 which establishes electrical connection to the primary wire 102 (FIG. 1) and the connecting wire 104 (FIG. 1).

In an exemplary embodiment, the housing 106 is substantially rectangular in shape and includes a top wall 112, a bottom wall 114 opposite the top wall 112, opposite side walls 116 and 118 extending between the top and bottom walls 112 and 114, and a real wall 120 interconnecting the top, bottom, side and rear walls 112, 114, 116 and 118. A forward end 122 of the housing is open and provides access to an interior cavity or receptacle 124 which houses the contact 110. The side walls 116 and 118 each include a rounded wire cradle 126 proximate the forward end 122, and the wire cradles 126 receive the primary wire 102 when the connector assembly 100 is in the terminated position. The side wall 116 of the housing also includes first and second connector wire openings 128, 130, which receive a connecting wire 104 when the connector assembly is used.

The stuffer 108 includes a bottom wall 140, left and right side walls 142 and 144, and a rear wall 146. The left and right side walls 142 and 144 include respective shelf portions 148, 150 which extend substantially parallel to the bottom wall 140 and define channels 152, 154 extending above the bottom wall 140. The left and right walls 142, 144 also include wire cradles 156, 158 which receive the primary wire 102 in use.

The housing 106 includes rails 160, 162 on the respective side walls 116 and 118, and slots 164, 166 extending on the side walls 116 and 118 above the rails 160 and 162. The housing rails 160 and 162 are received in the channels 152 and 154 of the stuffer when the connector assembly 100 is assembled, and the stuffer shelf portions 148, 150 are received in the housing slots 164, 166. The bottom wall 140 of the stuffer 108 includes a locking latch projection or tab 170 which engages the bottom wall 114 of the housing 106 as described below.

The contact 110 includes a substantially planar insulation displacement portion 180, upper and lower supporting ledge portions 182, 184 extending substantially perpendicular to the insulation displacement portion 180, and a poke in wire section 185 having first and second contact fingers or beams 186, 188 extending from an outer edge of the lower supporting ledge 184. The insulation displacement portion 180 and the supporting ledge portions 182 and 184 define a substantially C-shaped channel, and the contact beams 186, and 188 extend inwardly into the channel at an oblique angle to each of the portions 180, 182, and 184 of the contact 110. A wire opening or window 190 is formed into the poke in wire section 185 opposite the contact beams 186 and 188. The contact beams 186 and 188 define multiple contact positions for poke in-connections as explained further below.

The contact 110 is situated in the contact cavity 124 and retained thereto with the contact beams 186 and 188 aligned with the wire openings 128 and 130 in the housing side wall 116. The contact beams 186 and 188 are resiliently deflectable such that connecting wires 104 (FIG. 1) inserted through the wire openings 128, 130 in the housing side wall 116 deflect or move the contact beams 186 and 188 and trap the connecting wires 104 between distal ends of the contact beams 186 and 188 and the upper supporting ledge 182.

The multiple wire openings 128, 130 and the corresponding contact beams 186, 188 therefore provide multiple poke in wire positions for connecting wires 104, and thus more than one connecting wire 104 may be connected to the connector assembly 100. Peripheral devices located in the same general area could therefore be connected to the primary wire 102 using a single connector assembly 100 rather than multiple connectors which must be individually attached to the primary wire 102. While two wire openings 128, 130 in the housing 106 and two contact beams 186, 188 are provided in the embodiment of the FIG. 2, it is appreciated that more than two contact beams and wire openings could be provided in further and/or alternative embodiments of the invention.

Figure 3:
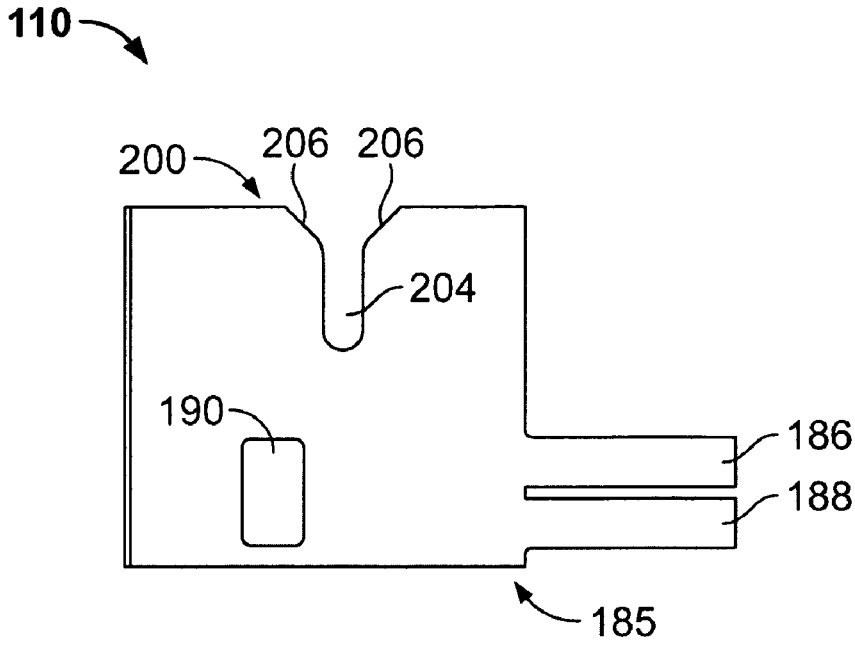
FIG. 3 is a top plan view of the contact shown in FIG. 2.

FIG. 3 is a top plan view of the contact 110 in blank or sheet form at an initial stage of manufacture. The contact 110 generally includes an insulation displacement section 200 and an a poke in section 185 extending from the insulation displacement section. The insulation displacement section 200 includes a wire channel 204 and beveled edges 206 which are configured to penetrate wire insulation of the primary wire 102 and establish mechanical and electrical connection with wire conductors therein.

The poke in section 185 is integrally formed with the insulation displacement section 200, and includes the first and second contact beams 186 and 188 extending outward and away from the insulation displacement section 200 and the wire opening 190. The contact 110 including the insulation displacement contact section 200 and the poke in wire section 185 is formed from a planar sheet of conductive material according to a known process, such as a stamping or punching process.

Figure 4:
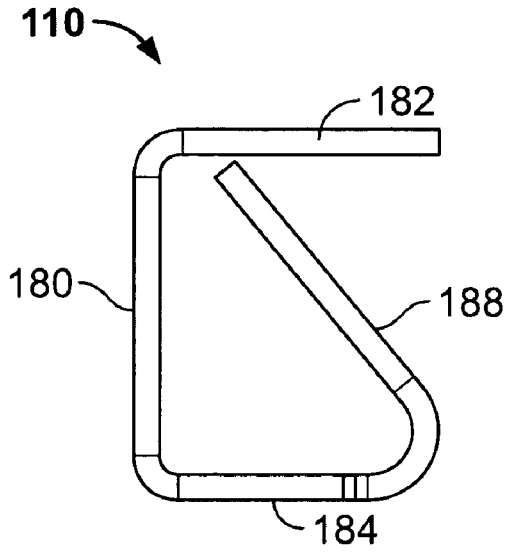
FIG. 4 is an end elevational view of the contact shown in FIG. 3.

FIG. 4 is an end elevational view of the contact 110 after the contact is shaped and formed. The contact is folded or bent such that the insulation displacement section 200 (FIG. 3) and the poke in section 185 (FIG. 3) are oriented to define the upper supporting ledge 182, the insulation displacement portion 180 (including the wire channel 204 shown in FIG. 3) extending from the upper supporting ledge 182, the lower supporting ledge 184 extending parallel to the upper supporting ledge 182, and the contact beams 186, 188 extending obliquely to the portions 180, 182, and 184 of the contact 110.

Figure 5:
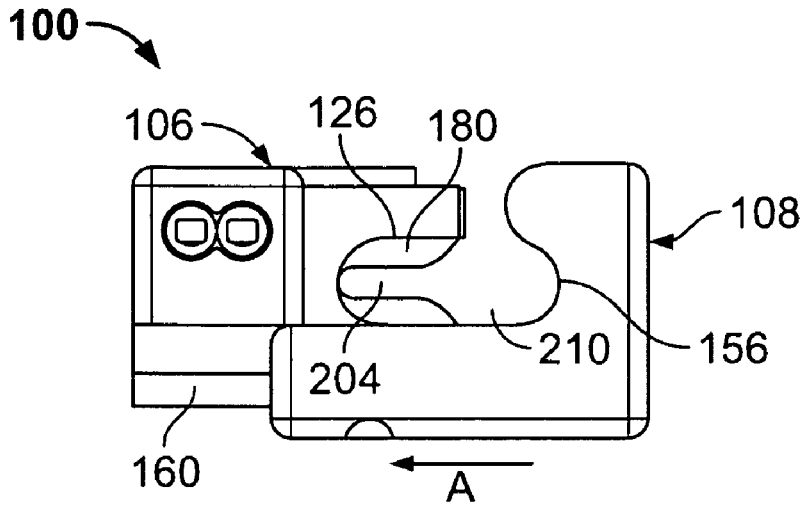
FIG. 5 is an assembled view of the connector assembly shown in FIG. 2.

FIG. 5 illustrates the connector assembly 100 in an assembled position wherein the stuffer 108 is assembled to the housing 106. The stuffer 108 is slidably positionable on the rails 160, 162 of the housing 106 and is movable in the direction of arrow A to the terminated position shown in FIG. 1. The wire cradles 156 of the stuffer are separated from the wire cradles 126 of the housing 106, and the wire channel 204 of the contact insulation displacement portion 180 is exposed in the wire cradles 126. A longitudinally extending wire cavity 210 extends between the housing 106 and the stuffer 108. When the primary wire 102 is received in the wire cavity 210, a longitudinal axis of the wire extends parallel to the cavity 210. When the stuffer 108 is moved relative to the housing 106, or vice versa, the primary wire 102 is brought into engagement with the contact insulation displacement portion 180, the wire insulation is pierced, and the wire conductors are received in the contact wire channel 204.

Figure 6:
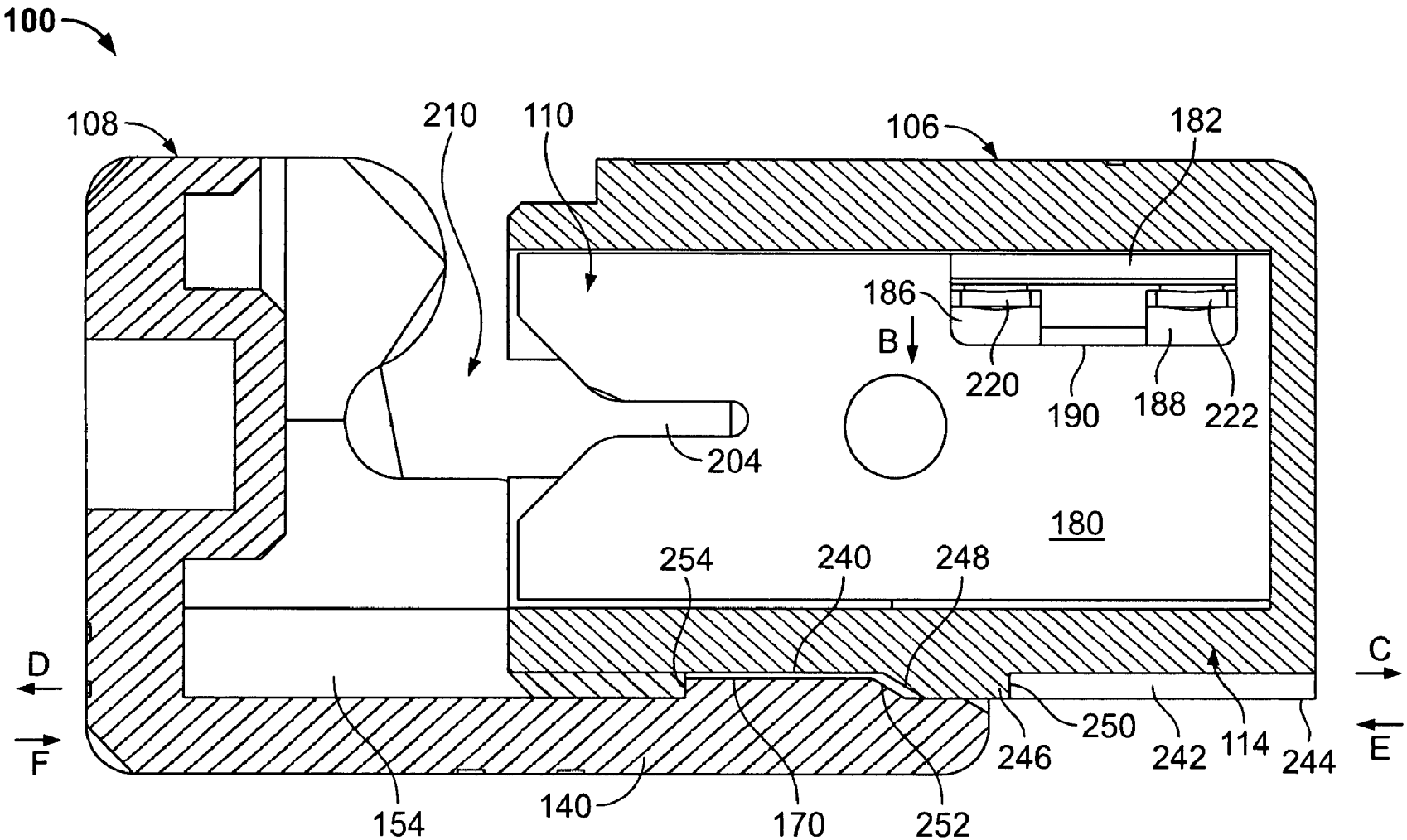
FIG. 6 is a sectional view of the connector assembly shown in FIG. 5.

FIG. 6 is a sectional view of the connector shown in FIG. 5 illustrating the contact 110 within the housing 106 and the stuffer 108 attached to the housing 106. The contact beams 186 and 188 include distal ends 220 and 222, respectively, which are in an abutting relationship to the upper ledge portion 182 of the contact 110 and located adjacent to the window 190 in the poke in wire section 185 of the contact 110. When a prepared or stripped connecting wire 104 is inserted into the respective wire opening 128, 130 of the housing 106, the distal ends 220 and 222 of the contact beams 186 and 188 are deflected by the wire 104 downwardly in the direction of arrow B and clamp the connecting wire 104 between the distal end 220, 222 and the upper support ledge 182.

The bottom wall 114 of the housing 106 includes a first locking recess 240 and a second locking recess 242 on an outer surface 244 of the bottom wall 114. The recesses 240, 242 are separated by a latch projection 246 having a sloped engagement surface 248 on one end and a perpendicular locking surface 250 on the other end.

The latch projection 170 on the bottom wall 140 of the stuffer 108 includes a sloped engagement surface 252 facing the engagement surface 248 of the housing latch projection 246, and a perpendicular locking surface 254 on the other end. The latch projection 170 of the stuffer 108 cooperates with the latch projection 246 of the housing 106 with two-stage locking engagement as described below.

In the assembled position illustrated in FIG. 6, the latch projection 170 of the stuffer 108 is received in the first locking recess 240 of the housing 106. The locking surface 254 of the latch projection 170 is securely engaged to the housing bottom wall 114 and resists any attempt to separate the housing 106 and the stuffer 108 by pulling the housing 106 in the direction of arrow C away from the stuffer 108, or alternatively by pulling the stuffer 108 in the direction of arrow D away from the housing 106.

When the primary wire 102 is received in the wire cavity 210, the connector assembly 100 may be moved to the terminated position by pushing the housing 106 in the direction of arrow E toward the stuffer 108, or alternatively by pushing the stuffer 108 in the direction of arrow F toward the housing 106, thereby advancing the housing 106 closer to the stuffer 108 in the stuffer channels 152, 154. Consequently, the housing latch projection engagement surface 248 slides over the stuffer latch projection engagement surface 252, thereby allowing the housing latch projection 246 to clear the stuffer latch projection 170. Once cleared, the stuffer latch projection 170 is received n the second locking recess 242 of the housing 106, and the housing latch projection locking surface 250 abuts the stuffer latch projection locking surface 254, thereby securely mating the housing 106 and stuffer 108 in the terminated position. As the housing 106 and/or stuffer 108 are moved to the terminated position, the wire cradles of the housing and stuffer 106 and 108 are adjacent one another, thereby forcing the primary wire 102 into the contact insulation displacement portion 180, which pierces the wire insulation and engages the wire conductors of the primary wire 102.

Figure 7:
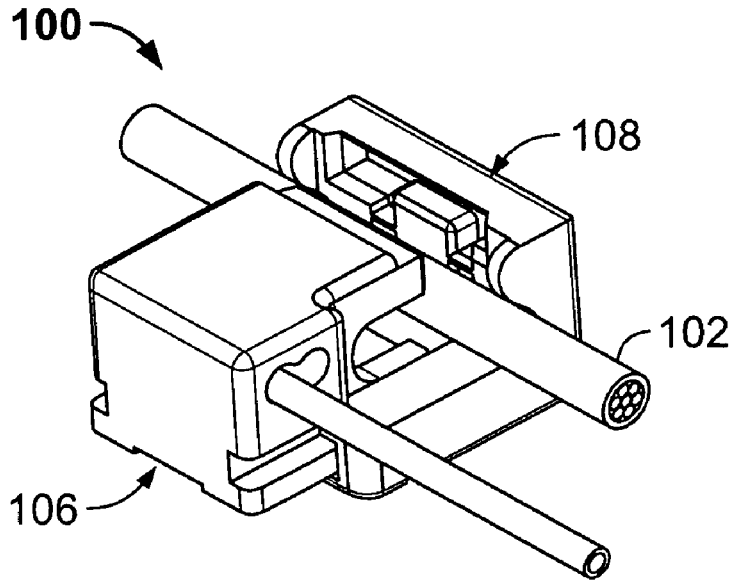
FIG. 7 is a perspective view of the connector assembly shown in FIG. 1 in an assembled position.

FIG. 7 is a perspective view of the connector assembly in the assembled position. The primary wire 102 is received in the wire cavity 210 (FIG. 1) so that the wire 102 extends axially and continuously through the connector assembly 100. The housing and stuffer 106 and 108 are moved toward one another in a direction transverse to the axis of the primary wire 102, thereby forcing the primary wire 102 into engagement with the contact 110 (FIG. 2) in the terminated position. The prepared or stripped connecting wire or wires 104 may be easily installed with a poke in-connection through the housing wire openings 128, 130. The connector assembly 100 is therefore installed simply and conveniently without the use of heavy or complicated tools and with minimal difficulty. Installation time and expense in comparison to known connectors is accordingly reduced, and because the connector assembly 100 may accommodate more than one connecting wire 104, multiple connecting wires 104 may be used with a single connector, thereby avoiding costs associated with obtaining and installing multiple individual connectors.

Figure 8:
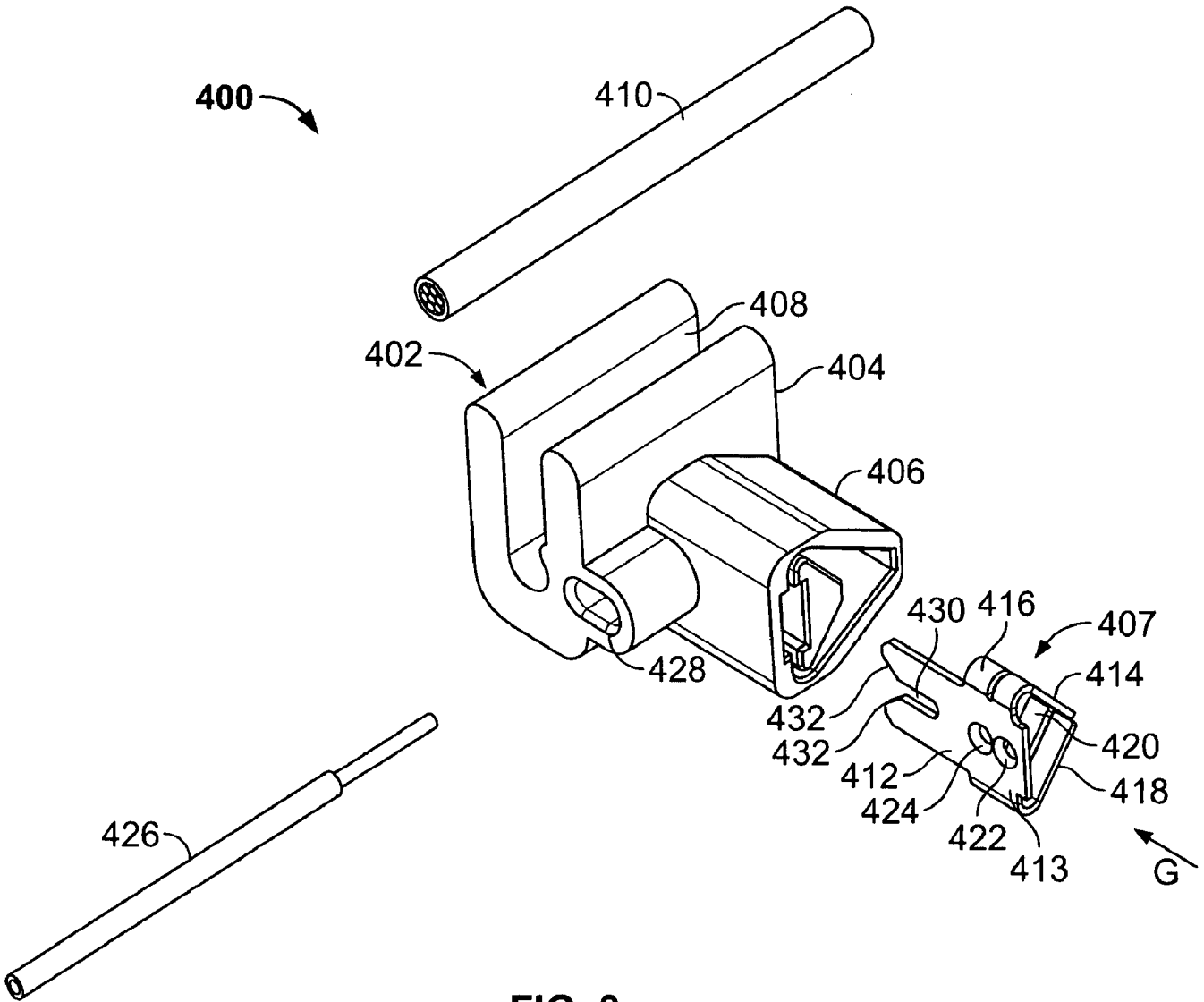
FIG. 8 is an exploded view of another embodiment of a wire tap connector assembly.

FIG. 8 is an exploded view of another embodiment of a wire tap connector assembly 400 formed in accordance with the present invention.

The connector assembly 400 includes a housing 402 having a wire receiving portion 404 and a stuffer portion 406, and a contact 407. The wire receiving portion 404 defines a wire cradle 408 dimensioned to receive a primary wire 410 axially and continuously through the housing 402.

The contact 407 is received in the stuffer portion 406 of the housing 402, and includes a substantially planar insulation displacement portion 412 and a poke in wire section 413 extending from the insulation displacement section 412. The poke in wire section includes angled contact beams 414, 416, 418 and 420 extending from the planar insulation displacement portion 412 in opposed pairs in a V-configuration. The contact beams 414, 416, 418 and 420 are resiliently deflectable and extend obliquely to the insulation displacement portion 412 of the contact 407. Distal ends of the contact beams 414, 416, 418 and 420 converge toward one another at a distance from the insulation displacement portion 412, and connecting wire openings 422 and 424 are formed in the insulation displacement portion 412. When a connecting wire 426 is received through the respective openings 422 and 424, the distal ends of the contact beams 414, 416, 418 and 420 are deflected and the end of the wire 426 is clamped between the respective pair of contact beams.

A wire receiving aperture 428 is formed in the connector housing 402, and the aperture 428 provides access to both of the openings 422 and 424 in the contact 407. Thus, multiple connecting wire positions are provided, and multiple prepared or stripped connecting wires 426 may be attached to the connector with a simple poke in connection.

The contact 407 includes a wire channel 430 and beveled edges 432 which are configured to penetrate wire insulation of the primary wire 410 and establish mechanical and electrical connection with wire conductors therein when the contact 407 is loaded into the housing stuffer portion 406. The contact 407 may be fitted into the housing stuffer portion 406 and engaged to the primary wire 410 with a known tool. The contact 407 is inserted in a direction G transverse to the wire cradle 408 of the housing 406.

The contact 407 may be integrally formed from a sheet of conductive material, according to, for example, a known punching or stamping process. The contact 407 may subsequently be bent, folded, or otherwise shaped into the configuration shown in FIG. 8.

While the invention has been described in terms of various specific embodiments, those skilled in the art will recognize that the invention can be practiced with modification within the spirit and scope of the claims.

What is claimed is:

1. A contact for a wire tap connector, said contact comprising:

a substantially planar insulation displacement portion configured to receive a primary wire and electrically connect thereto; and a poke in wire section integrally formed with and attached to said planar insulation displacement portion, said poke in wire section configured to accept prepared or stripped a connecting wire in at least one or more positions relative to said insulation displacement portion, wherein said poke in wire section includes a window and an angled contact beam extending toward or away from said window.

2. A contact in accordance with claim 1 wherein said contact beam extends obliquely to said insulation displacement portion.

3. A contact in accordance with claim 2 wherein said insulation displacement portion includes a first wire position opening and a second wire position opening therethrough, and said poke in wire section includes upper and lower contact beams converging toward one another at a distance from said respective first and second wire position openings.

4. A contact in accordance with claim 2 wherein said contact further includes first and second ledges extending substantially perpendicular to said insulation displacement portion, said poke in wire section extending between said first and second ledges and extending obliquely to said insulation displacement portion and extending obliquely to said ledges.

5. A contact in accordance with claim 1 wherein said poke in wire section extends in a V-configuration from said insulation displacement portion.

6. A wire tap connector comprising:

a housing having opposite side edges and a longitudinal cavity extending between said opposite side edges, said longitudinal cavity configured to receive a primary wire extending axially and continuously through the housing;

a contact situated in said housing, said contact having an insulation displacement portion extending into said cavity and a poke in wire section extending from said insulation displacement portion, said poke in wire section configured to receive a connection wire in one or more positions, wherein said housing includes an opening configured to accept a connecting wire, said opening located proximate the poke in wire section, said poke in wire section including a finger located proximate to, and extending at an angle relative to, said opening such that said finger engages the connection wire when inserted into the opening.

7. A wire tap connector in accordance with claim 6 further comprising a stuffer slidably mounted to said housing, said stuffer movable relative to said housing in a direction transverse to said longitudinal cavity.

8. A wire tap connector in accordance with claim 6, wherein said poke in wire section includes multiple fingers extending from said insulation displacement portion and oriented at an oblique angle thereto.

9. A wire tap connector in accordance with claim 6 further comprising a stuffer having a wire cradle, said stuffer slidably mounted to said housing and positionable between an assembled position wherein said cradle is separated from said insulation displacement portion and a terminated position wherein said cradle is adjacent said insulation displacement portion.

10. A wire tap connector in accordance with claim 6 wherein said contact includes a retention window, and at least one deflectable contact beam extending adjacent said retention window.

11. A wire tap connector in accordance with claim 6 wherein said insulation displacement portion includes at least one connecting wire opening, and said poke in wire section comprises opposite contact beams converging toward one another to grip a stripped wire passed through the connecting wire opening.

12. A wire tap connector in accordance with claim 6 wherein said contact has a V-configuration.

13. A wire tap connector comprising:

a housing having opposite side edges defining a wire cradle, said wire cradle configured to receive a primary wire along an axis of the wire;

a contact situated in said housing, said contact having an insulation displacement portion extending into said cradle, said insulation displacement portion is substantially planar, and said contact having a poke in wire section formed integral with and extending from said insulation displacement portion at an angle, said poke in wire section configured to receive a connection wire in one or more positions; and a stuffer selectively positionable relative to said housing to engage the primary wire to said insulation displacement portion.

14. A wire tap connector in accordance with claim 13 wherein said stuffer is configured for two stage latching with said housing.

15. A wire tap connector in accordance with claim 13 wherein said housing includes multiple wire openings in communication with said poke in wire section.

16. A wire tap connector in accordance with claim 13 wherein said contact further includes first and second ledges extending substantially perpendicular to said insulation displacement portion, said poke in wire section extending between said first and second ledges and extending obliquely to said insulation displacement portion and extending obliquely to said ledges.

* * * * *